United States Patent [19]

McGarvey

[11] Patent Number: 5,038,456

[45] Date of Patent: Aug. 13, 1991

[54] FIRE RESISTANT TANK CONSTRUCTION METHOD

[75] Inventor: David C. McGarvey, San Gabriel, Calif.

[73] Assignee: LRS, Inc., South El Monte, Calif.

[21] Appl. No.: 514,544

[22] Filed: Apr. 26, 1990

[51] Int. Cl.[5] ..... B28B 1/08

[52] U.S. Cl. ..... 29/460; 29/527.1; 270/421; 270/444; 270/445; 270/88.1

[58] Field of Search ..... 29/527.1, 527.7, 460; 220/88 R, 444, 445, 421, 425; 137/376, 565

[56] References Cited

U.S. PATENT DOCUMENTS

| | | | |
|---|---|---|---|
| 1,114,019 | 10/1914 | Morris . | |
| 1,273,195 | 7/1918 | Snyder . | |
| 1,625,765 | 4/1927 | Ratzenstein . | |
| 1,724,582 | 8/1929 | Hart . | |
| 2,460,054 | 1/1949 | Wiggins . | |
| 2,558,694 | 7/1951 | Speig . | |
| 2,772,834 | 12/1956 | Swenson et al. . | |
| 2,864,527 | 12/1958 | Altman et al. . | |
| 2,869,751 | 1/1959 | Klope et al. . | |
| 2,931,211 | 4/1960 | McCullough . | |
| 3,595,424 | 7/1971 | Jackson | 220/15 |
| 3,666,132 | 5/1972 | Yamamoto et al. | 220/444 |
| 3,702,592 | 11/1972 | Gamble . | |
| 3,827,455 | 8/1974 | Lee . | |
| 3,952,907 | 4/1976 | Ogden et al. . | |
| 3,969,563 | 7/1976 | Hollis, Sr. . | |
| 4,376,489 | 3/1983 | Clemens . | |
| 4,651,893 | 3/1987 | Mooney . | |
| 4,685,327 | 8/1987 | Sharp . | |
| 4,697,618 | 10/1987 | Youtt et al. | 220/88 R |
| 4,815,621 | 3/1989 | Bartis . | |
| 4,826,644 | 5/1989 | Lindquist et al. . | |
| 4,844,287 | 7/1989 | Long . | |
| 4,890,983 | 1/1990 | Solomon et al. . | |

OTHER PUBLICATIONS

Uniform Fire Code, 1985, Ed., pp. 203–278.
Reliance Tank sales materials (undated)—price list date 1-20-89.
Agape Tank sales materials (dated by postmark Jun. 7, 1989).
Brochure—"Underwriters Laboratory Listed Tank", Air Boy Sales and Manufacturing Company.
"Aro Air Operated Diaphragm Pumps", (1986).
"Aro Lubrication Equipment", (1989) pp. 31 and 33.
Cla-val Co. float control parts list (1977).
Doehrman, Inc.—facsimile dated May 9, 1989.
Safe-T-Tank Corp. sales materials dated 1987—Sales materials from Air Boy (Jun. 1988)—advertisement dated Feb., 1987 from Keesee, "Lube Cube" sales materials dated Jul. 1, 1988.
UL 142 Standard for Safety, Steel Aboveground Tanks (1987).
Husky 1030 Double Diaphragm Pump (1987) instructions and parts list.
"Oil Evacuation System", Aro Corp., (1982).
"½" Waste Oil Evacuation System (drawing dated Mar. 15, 1987).

*Primary Examiner*—Irene Cuda
*Attorney, Agent, or Firm*—William W. Haefliger

[57] ABSTRACT

The method of fabricating fire resistant tank apparatus adapted for transportation and for installation aboveground to receive and dispense a liquid hydrocarbon or hydrocarbons, includes providing a metallic tank assembly having lightweight wall means defining inner wall means, intermediate wall means and outer wall means, and spacing the wall means to form primary space between the intermediate wall means and the inner wall means, and secondary space between the intermediate wall means and the outer wall means; providing access porting to a tank interior defined by the assembly; a bottom wall defined by the assembly located to support the assembly at an installation side; and providing thermal barrier material in one of the first and second spaces to effectively define a shell about the tank interior. In addition, fire resistant material may be applied to the outer side or sides of the outer walls and hardened to define a relatively lightweight shell enclosing the tank assembly. The method provides structure that resists severe heat invasion in the form of radiation, convection and conduction to maintain liquid hydrocarbon in the innermost tank isolated from such invasion, the structure also being bullet resistant.

29 Claims, 3 Drawing Sheets

FIRE RESISTANT TANK CONSTRUCTION METHOD

BACKGROUND OF THE INVENTION

This invention relates generally to tanks for flammable and combustible liquids, and more particularly concerns methods and means for making such tanks fire resistant in above-ground installation environments.

Tanks holding flammable or combustible liquids, such as new and used hydrocarbon products, if installed above ground, can be dangerous if not "fireproofed", i.e., made "fire resistant". For example, if the tanks leak flammable liquid, a fire danger will exist. Fire can weaken the lightweight tank walls and lead to tank collapse and spillage of tank contents. Also, prior tanks were not, in general, bullet resistant.

In the past, such tanks were enclosed in concrete and transported to installation sites; however, the concrete is subject to cracking, which then can allow leakage to the exterior of flammable liquid leaking from the tank itself. Also, the concrete-enclosed tank is extremely heavy and difficult to transport. There is need for method and means to make such tanks fireproof and leak proof in such a way that a relatively lightweight unit is provided, for ease of transportation and installation, and subsequent safety.

SUMMARY OF THE INVENTION

It is a major object of the invention to provide an improved method of forming a tank assembly employing a thermal barrier or barriers between multiple tank walls, and meeting the above need. Basically, the method of the invention concerns forming of tank apparatus adapted for transportation for installation above-ground to receive and dispense a liquid hydrocarbon or hydrocarbons, and includes the following steps:

a) providing a metallic tank assembly having lightweight wall means defining inner walls means, intermediate wall means and outer wall means, and spacing the wall means to form primary space between the intermediate wall means and the inner walls means, and secondary space between the intermediate wall means and the outer wall means,
b) providing access porting to a tank interior defined by the assembly,
c) a bottom wall defined by the assembly located to support the assembly at an installation site,
d) and providing thermal barrier material in one of the first and second spaces to effectively define a shell about the tank interior.

As will be seen, the thermal barrier material may be filled into the second space, i.e., the space between the intermediate and outer walls of the assembly; and that barrier may be allowed to expand as a foam to enclose the tank interior at the top, bottom and sides thereof. The first space closer to the liquids containing tank interior, may be maintained free of the barrier material.

Another object is to fabricate the inner wall means to define an inner tank forming the tank interior, and fabricating the intermediate wall means to define an intermediate tank extending about the inner tank; and also to fabricate the outer wall means to define an outer tank extending about the intermediate tank.

Yet another object is to provide the thermal barrier to include:

i) a pre-formed block or blocks transmitting weight applied by the intermediate tank,
ii) a fill-in barrier extending about the block or blocks in the second space.

Also, fire-resistant material may be applied to an outer tank of the assembly defined by the outer wall means, with the thermal barrier means filling the space between the outer tank and an intermediate tank formed by the intermediate wall means. The fire-resistant material may be allowed to harden in situ to form a shell or shells, as will be explained.

Further, access porting may be provided at the top of the three wall tank assembly to enable access to the inner tank interior; the bottom wall of the inner tank may be supported by the bottom wall of the intermediate tank; and the latter may be supported by thermal barrier structure in the space between the bottom wall of the intermediate and the outer tanks.

These and other objects and advantages of the invention, as well as the details of an illustrative embodiment, will be more fully understood from the following specification and drawings, in which:

DRAWING DESCRIPTION

DETAILED DESCRIPTION

Figure 1:
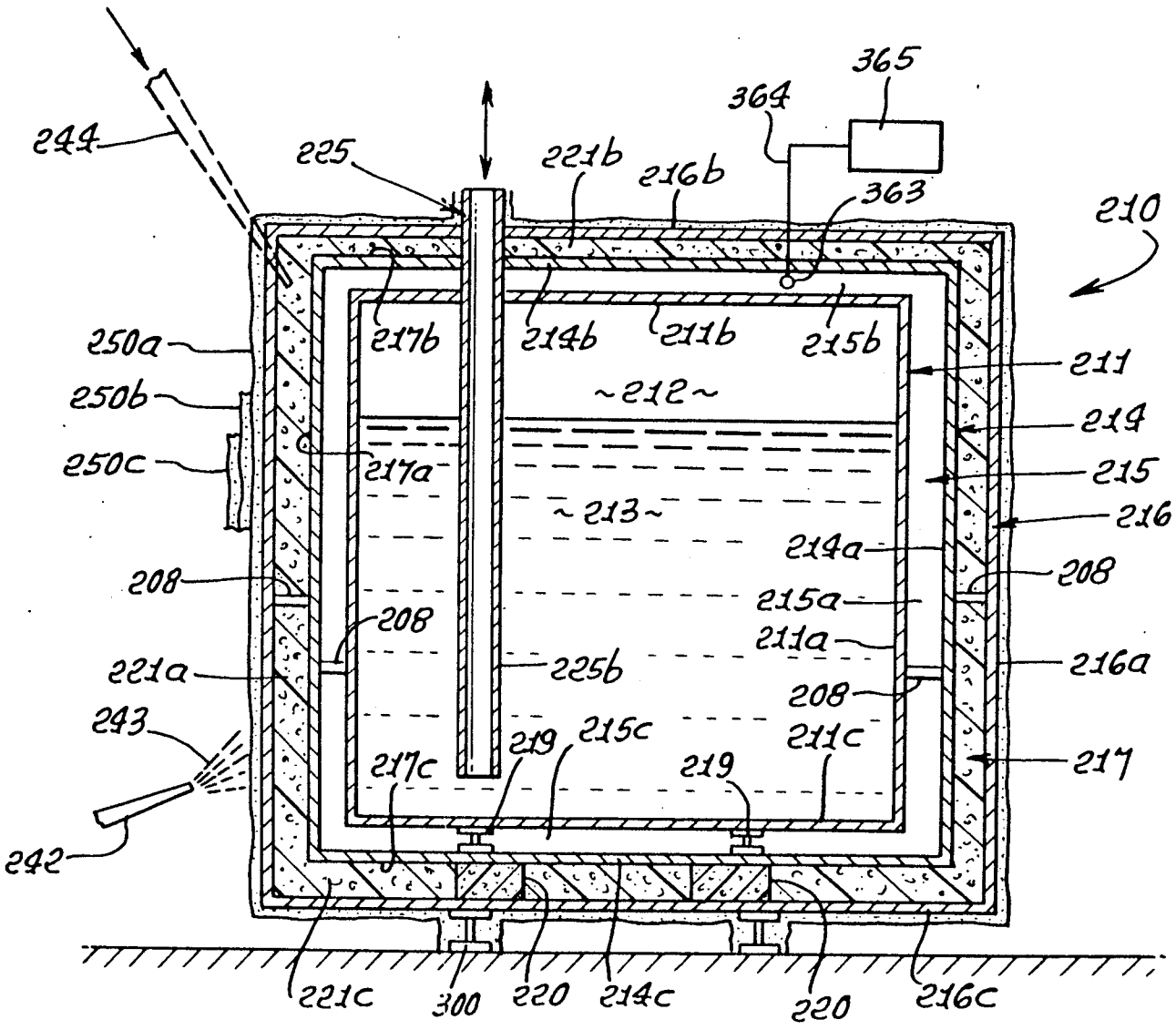
FIG. 1 is a perspective view of a metallic, three-wall tank assembly.

FIG. 1 shows a tank assembly 210 having lightweight wall means defining inner wall means 211, intermediate wall means 214 and outer wall means 216. The inner wall means 211 typically forms an inner tank having a side wall or walls 211*a*, top wall 211*b*, and bottom wall 211*c* whereby an inner tank interior is formed at 212 for containing liquid hydrocarbon indicated at 213, or hydrocarbons, or the like.

The intermediate wall means typically form an intermediate tank having a side wall or walls 214*a*, a top wall 214*b*, and bottom wall 214*c* whereby the intermediate tank encloses the inner tank, and a first space or spacing 215 is formed between the inner and intermediate tanks. See space 215*a*, 215*b* and 215*c*. The outer wall means typically forms an outer tank having side wall or walls 216*a*, top wall 216*b* and bottom wall 216*c* whereby the outer tank encloses the intermediate tank, and a second space or spacing 217 is formed between the outer and intermediate tanks. See space 217*a*, 217*b* and 217*c*.

The three tanks may be cylindrical, or may have multiple flat, parallel side walls. Side walls 211*a*, 214*a* and 216*a* may be parallel, as shown; top walls 211*b*, 214*b* and 216*b* may be parallel, as shown; and hollow walls 211*c*, 214*c* and 216*c* may be parallel, as indicated. Such walls may consist of steel and be less than one inch thick, for lightweight tank construction enhancing portability, for installation above ground at different sites, as desired. Glass fiber walls, or reinforced walls, resin impregnated, are also contemplated. Typically, steel walls are used and are about 10 gauge ($\frac{1}{8}$ to $\frac{1}{4}$ inch thick). The tank length may typically be about 5–20 feet. The walls are typically interconnected by welds at their junctions, and internal braces may be provided. The overall tank wall thickness is at least about two inches and is bullet (small caliber) resistant.

The weight of the inner tank and its liquid contents are transmitted to the intermediate tank, as via steel struts 219 in space 215*c* between bottom walls 211*c* and 214*c*. Such weight, together with the weight of the intermediate tank, is transmitted to the bottom wall 216*c* of the outer tank, as via thermal barrier blocks 220 assembled or positioned in second space 217*c*, as shown, when the tanks are being assembled. Side spacer struts may be provided, locally, as at 208. After positioning of all three tanks as shown, expansible, thermal barrier material is injected, as via nozzle 244, into space 217*a*, 217*b* and 217*c*, and may expand therein as foam, filling such space or spaces and including the intermediate tank. The barrier indicated at 221*a*, 221*b* and 221*c* fills the bottom space 217*c* about the thermal barrier (insulative) blocks 270, all such barrier means then blocking inwardly directed heat transmission to the intermediate steel tank. The barrier material cures in situ, after its injection and expansion. Usable thermal barrier materials include polyurethane foam, VERMICULITE, and the like. The final thermal barrier consists of the air and other gas in first space 215*a*, 215*b* and 215*c*, and prevents transmission to the contents of the inner tank of fire-generated heat which may for some reason have penetrated barrier foam 221*a*, 221*b* or 221*c*.

FIG. 1 also shows the provision of one or more pipe stubs 225 via which access may be gained to the tank assembly interior 212. As shown, the pipe 225 is connected to top walls 211*b*, 214*b* and 216*b* to extend through them, and above wall 211*b*. The pipe may be downwardly extended at 225*b* into the inner tank interior for remaining liquid from that interior, as well as filling liquid into that interior. One or more access ports may be provided to the spaces 215*b*, 217*b*, and to the interior space 212. Dipsticks may be inserted into the tank to measure the level of liquid hydrocarbon, i.e., flammable or combustible liquid (such as fuel) in the tank. Monitor means may be installed in the tank via one of the access ports to sense liquid level and transmit corresponding electrical signals to external apparatus that registers the liquid level for ready viewing.

Fire-resistant material is typically sprayed at 243, via a nozzle 242, onto the outermost tank walls 216*a*, 216*b* and 216*c* to form a first layer 250*a* which is allowed to harden or cure in situ. Then, if desired, a second nozzle, or the same nozzle, may be employed to spray the material onto layer 250*a*, forming a second layer 250*b*, also allowed to harden in situ. The combination of thus formed fire resistant sub-shells form a composite shell, leak resistant, fire resistant, and projectile resistant, typically having a thickness between ¼ inch and 1 inch, and which chars when heated to elevated temperatures (1,000° F. to 2,000° F.) as by intense flames.

Figure 2:
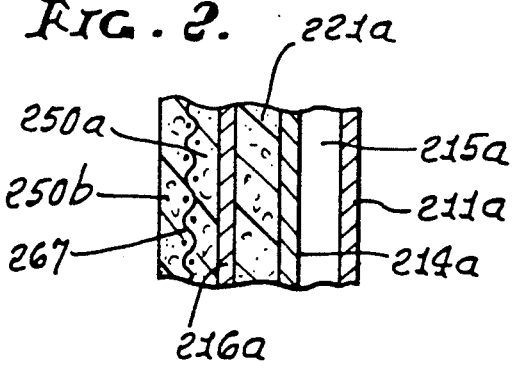
FIG. 2 is a fragmentary section showing multiple sub-shells of fire-resistant material applied to the outer tank of FIG. 1.

FIG. 2 shows a wire mesh 267 applied between layers or shells 250*a* and 250*b* for strengthening purposes. The application of fire-resistant material is preferably such as to coat the exposed pipe stub 225, and the supports 300 under the outer tank bottom wall 216*c*, as shown. An additional sub-shell of fire-resistant material may be used, as at 250*c*.

In order that the material 243 being sprayed on may cling to the upright metal walls without sagging out of position, and also to have optimum fireproofing effect, it typically has an epoxide resin base, and chars when exposed to flame. One example is the sprayable two component intumescent epoxy fireproofing system (CHARTEK) (liquid resin and hardener, mixed with methylene chloride, or *1,1,1,*-trichloroethane) supplied by Avco Specialty Materials, Lowell, Mass.

Further, prior to spraying the first layer 250*a* onto the outer tank walls, the latter are preferably sandblasted, and a primer coat applied to resist rusting. The primer coat may, for example, consist of polyamide epoxy resin, such as AMERON 71, SUBOX A8051, or VALCHEM 13-R-56, or ethyl silicate inorganic zinc (such as DIMETCOTE 6).

In FIG. 1, the tank assembly is supported by tank supports 300 beneath bottom wall 216*a* and supported by exterior surface 301. The supports have lateral sides which are covered by the fire-resistant material, as at 250*a*'.

Any fluid leaking from inner tank 211 via inner wall or walls 211*a*, 211b, 211*c*, or 211*d* passes first to space 215. Such leakage may be detected, as by a sensor 363 sensing volatile gases emitted, or liquids accumulating in space 215, as from a flammable hydrocarbon. The sensor is connected at 364 to an external monitoring device 365, as shown.

Figure 3:
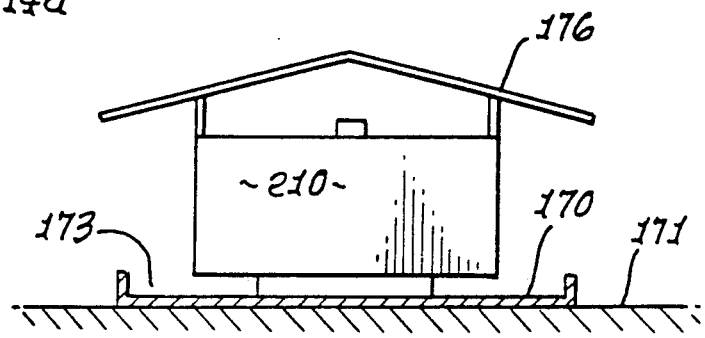
FIG. 3 is a side elevation showing the fireproofed tank supported in a shallow receptacle at an installation site.

FIG. 3 shows a fireproof material coated tank, stub pipes, and supports, installed at a work site, in a basin 170 supported on the ground 171. The basin forms a collection zone 173 beneath the tank to collect any possible leakage of flammable liquid. A hood 176 may be provided over the tank and basin to prevent rainwater accumulation in the basin.

Properties of the "CHARTEK" fireproofing system or material are as follows:

TABLE 1

CHARTEK MECHANICAL PROPERTIES

| Property | ASTM Reference | Value | Conditions |
|---|---|---|---|
| Tensile Strength | D638 | 2750 psi<br>$19.0 \times 10^6$ PA | Room Temp. |
| Modulus | | $3.42 \times 10^5$ psi<br>$2.36 \times 10^9$ PA | Room Temp. |
| Compressive Strength | D659 | 6342 psi<br>$43.7 \times 10^6$ PA | Room Temp. |
| Modulus | | $1.89 \times 10^5$ psi<br>$1.3 \times 10^9$ PA | Room Temp. |
| Impact Strength (unsupported, unmeshed) | D256 | 0.42 ft lbs/in<br>0.22 J/cm | Room Temp. notched |
| | | 0.71 ft lbs/in<br>0.38 J/cm | Room Temp. unnotched |
| Flexural Strength | D790 | 4290 psi<br>$29.6 \times 10^6$ PA | Room Temp. |
| Modulus | | $3.32 \times 10^5$ psi<br>$2.3 \times 10^9$ PA | Room Temp. |
| Hardness | Shore D | 83 | D Scale |
| Bond Strength | D1002 | 1578 psi<br>$10.9 \times 10^9$ PA | Primed, room temp. |

TABLE II

PHYSICAL PROPERTIES

| Property | ASTM Reference | Value | Conditions |
|---|---|---|---|
| Density | D792 | 79 lbs/ft$^3$<br>1.27 g/cc | After spraying |

TABLE II-continued

| PHYSICAL PROPERTIES | | | |
|---|---|---|---|
| Property | ASTM Reference | Value | Conditions |
| Thermal Conductivity | C177 | 2.10 BTU in/ft$^2$ hr °F. | At 68° F. |
| | | 0.302 W/m °C. | At 20° C. |
| | | 1.96 BTU in/ft$^2$ hr °F. | At 154° F. |
| | | 0.283 W/m °C. | At 68° C. |
| Thermal Expansion With Mesh | D696 | $20.5 \times 10^{-6}$ in/in °F. | From −70° F. |
| | | $36.9 \times 10^{-6}$ cm/cm °C. | (−57° C.) to |
| Thermal Expansion Without Mesh | | $36.4 \times 10^{-6}$ in/in °F. | 150° F. |
| | | $65.5 \times 10^{-6}$ cm/cm °C. | (66° C.) |
| Specific Heat | Differential Scanning Calorimetry | 0.33 BTU/lbm °F. | At 86° F. |
| | | 1.38 J/Kg °C. | At 30° C. |
| | | 0.23 BTU/lbm °F. | At 500° F. |
| | | 0.96 J/Kg °C. | At 260° C. |
| Oxygen Index | D2863 | 32 | |
| Flash Point | D92 | | |
| Component I | | Over 200° F. (93° C.) | Open cup |
| Component II | | Over 200° F. (93° C.) | Open cup |
| Viscosity | | | |
| Component I | | 285000 CPS | At 100° F. (37.8° C.) |
| Component II | | 60000 CPS | At 100° F. (37.8° C.) |
| Gas (Nitrogen) Permeability | D1434 | $1.6 \times 10^{-9} \frac{\text{in}^3\ (\text{STP})\ \text{in}}{\text{sec. in}^2\ \text{Atm}}$ | At 68° F., 1.51 Atm |
| | | $1.36 \times 10^{-10} \frac{\text{cm}^3\ (\text{STP})\ \text{cm}}{\text{sec. cm}^2 \cdot \text{cmHg}}$ | At 20° C., 1.53 Bar |
| Water Vapor Transmittance | E96 | $1.013 \times 10^{-3}$ gr/hr ft$^2$ | At 73° F. (22.8° C.) |
| | Procedure B | $4.07 \times 10^{-1}$ g/hr m$^2$ | and 50% RH |
| Pot Life | | 55 minutes | At 70° F. (21° C.) |
| Gel Time | | 8 hours | At 60° F. (16° C.) |
| | | 4 hours | At 80° F. (27° C.) |
| Cure Time to Shore A of 85 | | 18 hours | At 60° F. (16° C.) |
| | | 8 hours | At 80° F. (27° C.) |
| Color | | Grey | |
| Maximum Service Temperature | | 150° F. (66° C.) | Continuous Use |

Figure 5:
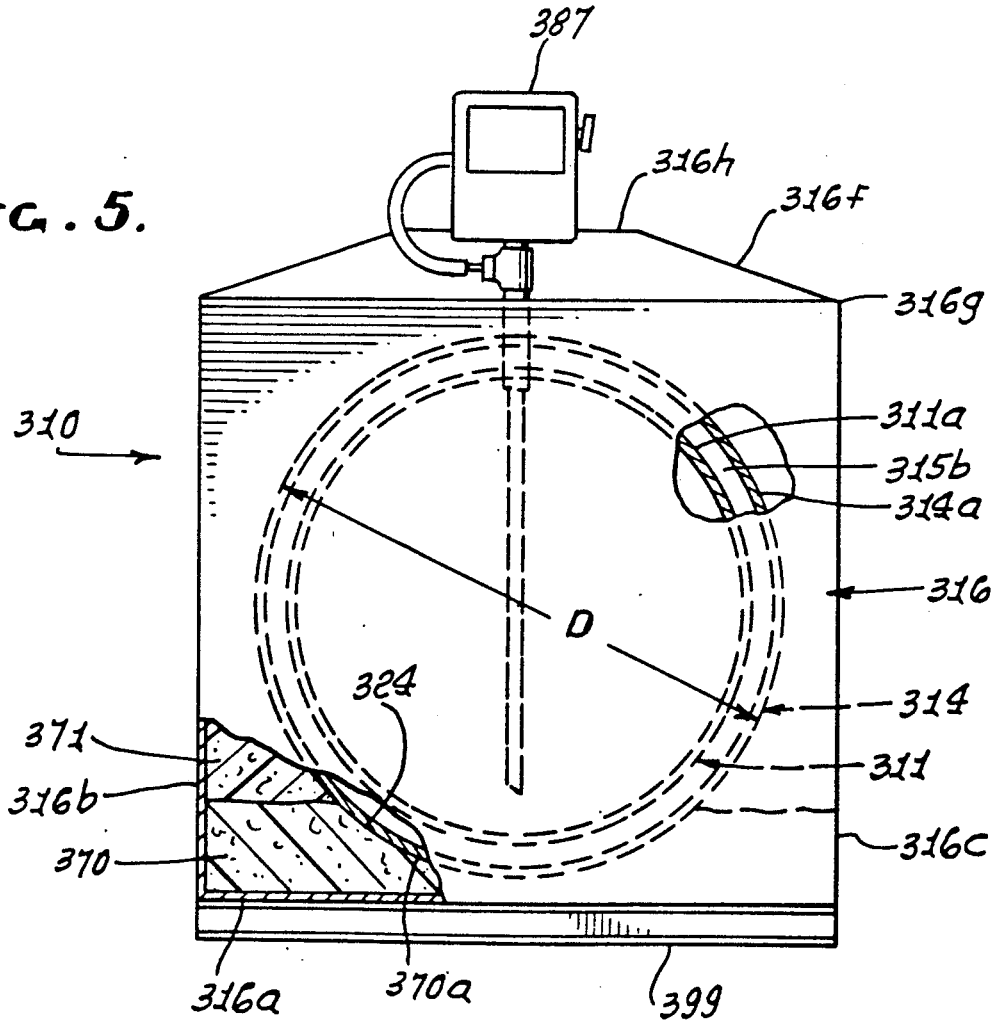
FIG. 5 is an end view of the FIG. 4 apparatus.
Figure 4:
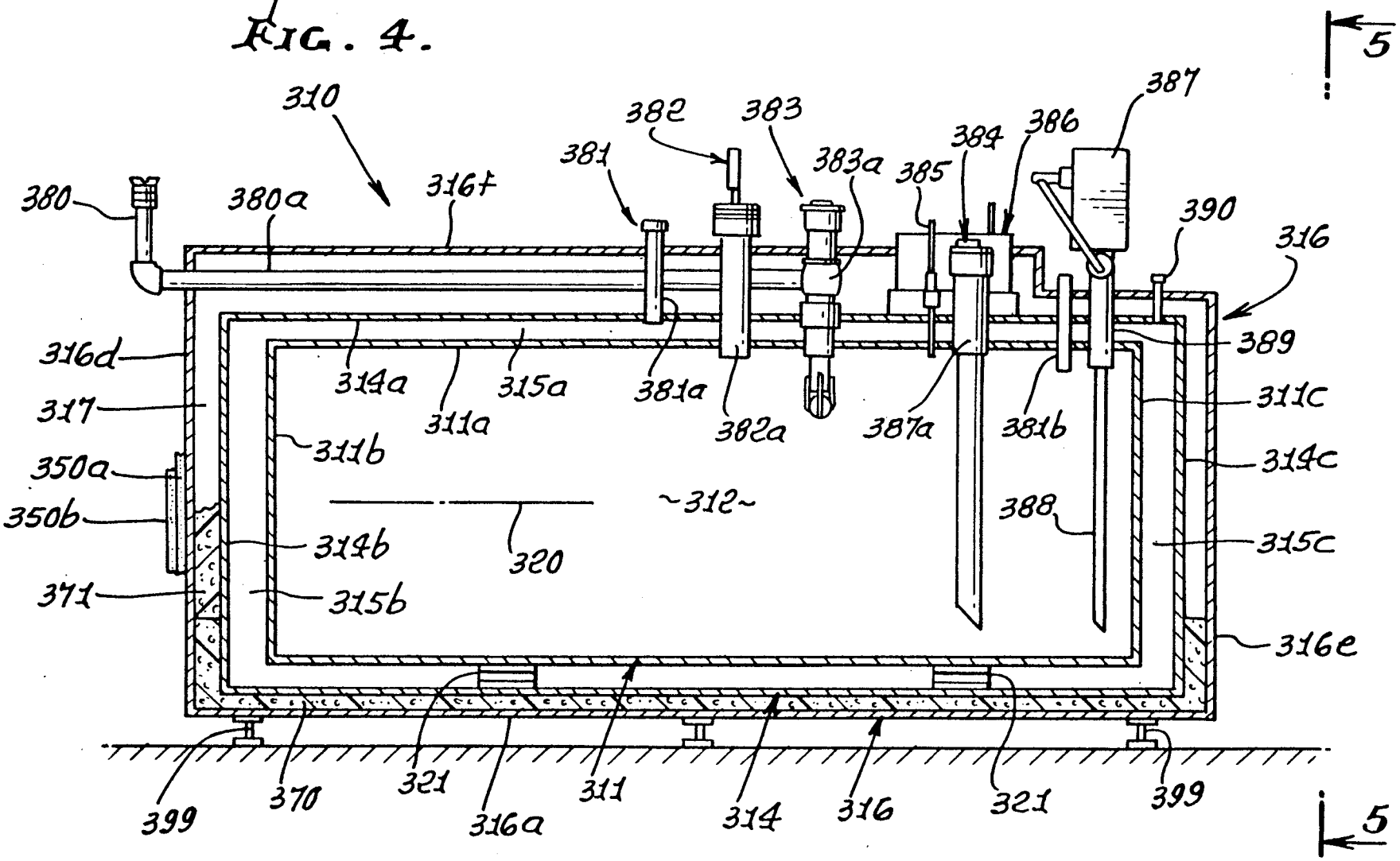
FIG. 4 is a view of modified triple-hulled tank apparatus.

FIGS. 4 and 5 show a multiple wall tank assembly 310 having steel wall means defining an inner tank 311, intermediate tank 314, and outer tank 316. Tanks 311 and 314 are cylindrical and horizontally elongated, having a common axis 320. They have concentric side walls 311*a* and 314*a*, parallel vertical end walls 311*b* and 314*b* at one end, and parallel vertical end walls 311*c* and 314*c* at their opposite ends. The two tanks 311 and 314 are spaced apart at 315*a*, 315*b* and 315*c*. Metal struts 321 in lower extent of space 315*a* support the inner tank and its contents on the side wall 314*a* of the intermediate tank.

The outer tank 316 is rectangular, not cylindrical, but is horizontally elongated in the direction of axis 320. It has a bottom steel wall 316*a* elongated upright side walls 316*b* and 316*c*, upright ends walls 316*d* and 316*e*, and top wall 316*f* is tapered from level 316*g* to level 316*h*. The three tanks serve the same purposes and functions, as referenced in FIGS. 1 and 2. However, the two cylindrical tanks 311 and 314 are assembled as a unit into outer tank 316, as by lowering onto a saddle 324 formed as by thermal barrier material 370 (corresponding to blocks 270 in FIGS. 1 and 2) previously filled into the outer tank, cured, and forming a concave upper surface 370*a* to match the convex curvature of diameter D, of tank wall 314*a*. See FIG. 5. Subsequently, thermal barrier material is filled into space 317 between tanks 314 and 316 to fill that space at the sides and top of tank 314. Such added thermal barrier material is indicated at 371 in FIGS. 4 and 5. Such barrier material corresponds to that at 221*a*, 221*b* and 221*c* in FIGS. 1 and 2. At the top of tank 314 the thermal barrier material is thickened due to top wall taper at 316*f*. Fire-resistant material is added in layers at 350*a* and 350*b*, corresponding to sub-shells 250*a* and 250*b* in FIG. 1.

Equipment located at the top of the tank assembly is as shown, and includes

- primary tank work vent 380 and elongated duct 380*a* connecting to 383
- secondary tank work vent 381 with duct 381*a*
- tank gauge unit 382 accessing inner space 312, via duct 382*a*
- vapor recovery duct 383 accessing space 312, via duct 383*a*
- fluid product fill duct 384 accessing 312
- fluid product spill drain duct 385
- fluid spill container 386 associated with 385 product dispenser 387, and associated suction line 388 and vapor return duct 389; see also pipe 387*a* through tank walls, and pipe 377*a'* monitor port 390 via which fluid leaking into open (unfilled) space 315 may be monitored, i.e., detected, as by a sensor 363 a liquid product return line 381*b*.

Tank supports appear at 399.

Space 315 in FIG. 4 and space 215 in FIG. 8 may contain, or be filled, with a non-oxidizable inert gas, such as $N_2$ for enhanced protection in case of leakage of hydrocarbon into the space. Also, the space 317 may contain a barrier layer, such as silica, adjacent side walls of outer tank 316, and which does not foam or bubble when heated to 1,200° F., for example. The assembly, as described, provides protection for the hydrocarbon contents such that up to 2,000° F. flame applied for a considerable period of time (1 to 2 hours) to the fire resistant outer shell 00 on the assembly will not result in heating of the hydrocarbon contents in space 312 (or space 212 in FIG. 1) above about 10% of ambient temperature.

Elongated duct 380*a* is usable as an additional reservoir for heat expanded tank (in space 302) if needed.

The thermal barrier material (in space 217, 220, 371, and 321) may for example consist of the following: Insta-Foam Products, Inc. two components ("A"—activator and "B"—resin) combinable system, further identified as follows:

| IDENTIFICATION (A COMPONENT) | |
|---|---|
| Product: | "A" components for froth refill. |
| Chemical Family: | Aromatic isocyanate with halogenated hydrocarbon |
| Chemical Name: | Product is a mixture of polymeric diphenylmethane diisocyanate (MDI), dichlorodifluoromethane (R-12) and nitrogen. |
| Synonyms: | Urethane "A" component, iso, isocyanate, activator |
| DOT Class: | Compressed gas N.O.S., non-flammable gas UN 1956 |

| INGREDIENTS: | % |
|---|---|
| 4.4' Diphenylmethane Diisocyanate (MDI) CAS #101-68-8 | <50 |
| Higher oligomers of MDI CAS #9016-87-9 | <50 |
| Dichlorodifluoromethane (R-12) CAS #75-71-8 | <20 |

| PHYSICAL DATA: | |
|---|---|
| Appearance: | Liquid and gasses under pressure - frothy liquid upon release from the tank. |
| Color: | Dark brown to amber. |
| Odor: | Mild fluorocarbon odor. |
| Boiling Point: | R-12 is present as a liquified gas and at one atmosphere boils at −21.6° F. or −30° C. MDI is present as a viscous liquid and boils at 406° F. (208° C.) at 5 mm Hg. |
| Vapor Pressure: | Before the addition of nitrogen, the vapor pressure of the mixture is about 2700 mm Hg. |
| Vapor Density (Air = 1): | 8.5 (MDI) |
| Solubility in Water: | Reacts slowly with water to liberate carbon dioxide. |
| Specific Gravity (Water = 1): | 1.3 |
| % Volatile by Weight: | Less than 20%. |

| IDENTIFICATION (B COMPONENT) | |
|---|---|
| Product: | "B" Components for froth refill (densities 1.5 pcf through 4.0 pcf) |

-continued

| | |
|---|---|
| Chemical Family: | Urethane Resin |
| Chemical Name: | Product is a mixture of polyols, urethane catalysts, silicone surfactant, fluorocarbons (R-11 and R-12), flame retardants, and nitrogen. |
| Synonyms: | Urethane "B" Component, Resin |
| DOT Class: | Compressed gas N.O.S., non-flammable gas UN 1956. |

| INGREDIENTS: | % |
|---|---|
| Polyol | <70 |
| Silicone Surfactant | <2 |
| Flame Retardants | <30 |
| Catalyst | <10 |
| Trichlorofluoromethane (R-11) (CAS #73-69-4) | <30 |
| Dichlorodifluoromethane (R-12) (CAS #75-71-8) | <15 |

| PHYSICAL DATA: | |
|---|---|
| Appearance: | Liquid and gasses under pressure - frothy liquid upon release from the tank. |
| Color: | Brown to light yellow. |
| Odor: | Mild fluorocarbon odor. |
| Boiling Point: | R-12 is present as a liquified gas and at one atmosphere boils at −21.6° F. or −30° C. |
| Vapor Pressure: | Before the addition of nitrogen, the vapor pressure of the mixture is about 2500 mm Hg. |
| Vapor Density (Air = 1): | Greater than 1 (fluorocarbon). |
| Solubility in Water: | Partly soluble; does not react. |
| Specific Gravity (Water = 1): | 1.2 |
| % Volatile by Weight: | Less than 35. |

I claim:

1. In the method of fabricating a fire resistant tank apparatus for transportation and for installation above-ground to receive and dispense a liquid hydrocarbon or hydrocarbons, the steps including a) providing a metallic tank assembly having light-weight wall means defining inner wall means, and outer wall means forming an outer tank, and spacing said inner and outer wall means to form a space therebetween said inner wall means defining a horizontally elongated cylindrical tank, b) providing access porting to a tank interior defined by the cylindrical tank, c) locating a bottom wall defined by the tank assembly to support the tank assembly at an installation site, d) and providing thermal barrier material in said space to effectively define a shell about said tank interior, said providing including flowing said material downwardly about and beneath said inner wall means after downward installation of said cylindrical tank in said outer tank and after providing support means beneath said inner wall means and within said outer tank.

2. The method of claim including substantially filling said space with said thermal barrier material.

3. The method of claim 2 wherein said filling step is carried out to effectively enclose said cylindrical tank at the top, bottom and sides thereof.

4. The method of claim 1 including introducing an inert gas into said space.

5. The method of claim 1 including filling said space with said thermal barrier material to effectively enclose said cylindrical tank at the top, bottom and sides thereof.

6. The method of claim 1 including applying fire resistant material to said tank assembly at the outer side thereof.

7. The method of claim 6 including applying said fire resistant material to the outer wall means to a thickness between about ¼ inch and 1 inch, said material characterized as charring when exposed to flame.

8. The method of claim 6 including allowing said fire resistant material to harden in situ to define a relatively lightweight shell enclosing said apparatus, the shell having a thickness between about ¼ inch and 1 inch.

9. The method of claim 8 wherein said material has an intumescent epoxide resin base.

10. The method of claim 8 including embedding wire mesh into the shell.

11. The method of claim 8 including connecting at least one upright pipe stub to the tank assembly top wall, and via which access may be gained to the tank assembly interior, and extending said shell into position adjacent to and about the pipe stub.

12. The method of claim 8 including providing tank supports to project downwardly from the tank assembly, and extending the shell into position adjacent to said supports.

13. The method of claim 8 wherein said fire resistant material consists of the product CHARTEK.

14. The method of claim 1 wherein said thermal barrier material includes i) a pre-formed block or blocks transmitting weight applied to the outer tank, and ii) synthetic resin foam extending about said block or blocks in said space, and allowed to cure, in situ.

15. The method of claim 1 including locating metallic strut means in said space for transmitting weight applied by the cylindrical inner tank and the contents thereof.

16. The method of claim 1 wherein each of the inner, and outer tank wall means consists of steel and has about 10 gauge thickness.

17. The method of claim 1 including transferring said liquid hydrocarbon or hydrocarbons, into said tank interior to be protectively concealed and contained therein.

18. The method of claim 1 including orienting the outer tank to have vertical side walls and end walls.

19. The method of claim 18 including orienting the outer tank to have a top wall that is upwardly tapered.

20. The method of claim 1 wherein said thermal barrier material includes a silica-containing layer.

21. The method of claim 1 wherein said provision of access porting includes providing and orienting an elongated tube to extend between two walls defined by said upper wall means to serve as a heat expanded hydrocarbon vapor reservoir.

22. The method of claim 1 wherein said provision of access porting includes providing at least two of the following, connected through the tanks at upper walls thereof:

a primary inner tank work vent duct, a vapor recovery duct, a fluid product fill duct, an elongated vapor reservoir duct connected between said work duct and said vapor receiving duct, a tank gauge duct, a fluid product spill drain duct, a product dispenser duct, liquid product return line.

23. The method of claim 1 wherein said provision of access porting includes providing and connecting the following, connected through walls of the tanks to access space between the tanks:

a tank work vent duct, and a monitor port for monitoring vapor in said space.

24. The method of claim 1 wherein said wall means comprises one of either: metal and glass fiber.

25. The method of claim 1 including providing said tank assembly to be at least about 2 inches thickness to be bullet resistant.

26. The method of claim 1 including providing an overfill box, with a return plunger, located in the outer tank.

27. In the method of fabricating a fire resistant tank apparatus for transportation and for installation above ground to receive and dispense a liquid hydrocarbon or hydrocarbons, the steps including a) providing a metallic tank assembly having lightweight wall means defining inner wall means, intermediate wall means and outer wall means, and spacing said wall means to form a first space between the intermediate wall means and the inner wall means, and a second space between the intermediate wall means and the outer wall means, b) providing access porting to a tank interior defined by the tank assembly, c) locating a bottom wall defined by the tank assembly to support the tank assembly at an installation site, d) and providing thermal barrier material in one of said first and second spaces to effectively define a shell about said tank interior, e) applying fire resistant material to said tank assembly at the outer side thereof, said fire resistant material being allowed to harden in situ to define a relatively lightweight shell enclosing said tank assembly, the shell having thickness between about ¼ inch and 1 inch, f) said fire-resistant material being applied in layers to form:

i) a first sub-shell extending into contact with said tank outer wall means, and hardened in situ, the first sub-shell having an outer surface, and ii) a second sub-shell extending into contact with said first sub-shell outer surface and hardened in situ.

28. The method of claim 27 wherein said fire-resistant material is applied to form at least one additional sub-shell hardened in situ about the outer surface of the next sub-shell closer to the tank walls.

29. In the method of fabricating a fire resistant tank apparatus for transportation and for installation aboveground to receive and dispense a liquid hydrocarbon or hydrocarbons, the steps including a) providing a metallic tank assembly having multiple lightweight wall means including inner wall means, and outer wall means, and spacing said multiple wall means to form spaces therebetween, said inner wall means defining a horizontally elongated cylindrical tank, b) providing access porting to a tank interior defined by the cylindrical tank, c) locating a bottom wall defined by the tank assembly to support the tank assembly at an installation site, d) providing thermal barrier material in at least one of said spaces and in two portions to effectively define a shell about said cylindrical tank, e) providing the thermal barrier material first portion to form a saddle, lowering the cylindrical tank onto said saddle, and then applying the thermal barrier material second portion to extend above the saddle and about the upper extent of the saddle supported cylindrical tank.

* * * * *